United States Patent [19]

Takahashi et al.

[11] Patent Number: 4,885,503

[45] Date of Patent: Dec. 5, 1989

[54] COLOR CATHODE-RAY TUBE

[75] Inventors: Eiki Takahashi, Hitachi; Masahiro Miyazaki, Mobara; Kiyoshi Nakamura, Hitachi, all of Japan

[73] Assignee: Hitachi, Ltd., Tokyo, Japan

[21] Appl. No.: 272,065

[22] Filed: Nov. 16, 1988

[30] Foreign Application Priority Data

Nov. 18, 1987 [JP] Japan ..... 62-289430
Aug. 31, 1988 [JP] Japan ..... 63-214986

[51] Int. Cl.[4] ..... H01J 29/48; H01J 29/06

[52] U.S. Cl. ..... 313/450; 313/449; 313/240; 445/36

[58] Field of Search ..... 313/424, 445, 446, 449, 313/450, 451, 479, 240; 445/35, 36, 46, 49

[56] References Cited

U.S. PATENT DOCUMENTS 3,183,388 5/1965 Townsend et al. ..... 313/451
3,560,779 2/1971 May ..... 313/414
4,665,340 5/1987 Odenthal et al. ..... 313/240 X

FOREIGN PATENT DOCUMENTS 47-32227 of 1972 Japan .

*Primary Examiner*—Ulysses Weldon
*Assistant Examiner*—Sandra L. O'Shea
*Attorney, Agent, or Firm*—Antonelli, Terry & Wands

[57] ABSTRACT

A particle shielding element of a shape memory metal is installed between an electroconductive layer on the inner peripheral surface of a neck glass tube of a cathode-ray tube and a shield cup of an electron gun therein to close a gap between the neck glass tube and the shield cup for thereby guarding the electronic gun against invasion of particles, Before the particle shielding element is inserted into the neck glass tube, the element is deformed to reduce its outer diameter so that the element can be inserted into the neck glass tube without scratching the electroconductive layer. After the element has been installed in Position in the neck glass tube, the temperature therein is adjusted to cause the element to recovery to its initial shape into dust sealing engagement with the electroconductive layer.

24 Claims, 22 Drawing Sheets

COLOR CATHODE-RAY TUBE

BACKGROUND OF THE INVENTION

1. FIELD OF THE INVENTION

The present invention relates to a color cathode-ray tube which is improved to prevent invasion of particles into an electron gun.

2. DESCRIPTION OF THE PRIOR ART

Japanese Examined Patent Publication No. 4732227 discloses a color cathode-ray tube in which a foreign matter shielding element (or "particle shielding element") is formed by a partition plate disposed at the junction between a shield cup of an electron gun and an anode to seal or close a gap between the shield cup and a neck tube glass. More specifically, as shown in FIG. 42 of the present application, the partition plate 4 is a circular metallic plate provided to close the gap between the shield cup 2 of the electron gun 1 and the inner peripheral surface of the neck tube glass 3 to thereby guard the electron gun 1 against the invasion of particles from a funnel glass 5. This design of the prior art cathode-ray tube, however, suffers from a problem to be discussed hereunder.

An electron gun of a cathode-ray tube comprises a plurality of electrodes including a cathode, grid electrodes and an anode. A proper electric potential is applied to each of the electrodes so that they produce electron beams of an excellent convergence. It is known that, if particles are present between the electrodes of the electron gun, the voltage-proof of the electron gun is remarkably deteriorated. To improve the voltage-proof of the electron gun, therefore, it is effective to guard the electron gun against the invasion of such particles.

With the design of the prior art cathode-ray tube discussed above, however, a high electrical field is generated at the point of contact between the inner peripheral surface of the neck tube glass 3 and the outer peripheral edge of the metallic partition plate 4. As a result, tree-shaped dielectric breakdowns are formed and gradually grow into the material of the neck tube glass 3 in a long time until the breakdowns penetrate the thickness of the wall of the neck tube glass 3. In an attempt to eliminate such a problem, a structure can be designed in which the inner peripheral surface of the neck tube glass 3 is coated with an electroconductive layer 8 in contact with the metallic partition plate 4. This structure, however, again suffers from a problem that, when the electron gun 1 and the partition plate 4 are introduced into the neck glass tube 3, the partition plate 4 is moved in frictional contact with the electroconductive layer 8 to produce particles peeled off from the layer 8 and that the particles thus produced would be introduced into the electron gun.

SUMMARY OF THE INVENTION

It is an object of the present invention to provide a color cathode-ray tube which is designed to eliminate the problems discussed above.

It is another object of the present invention to provide a color cathode-ray tube in which a particle shielding element is provided to close the gap between the neck tube glass and the shield cup to prevent invasion of particles into the electron gun while preventing frictional sliding movement of the particle shielding element relative to the electroconductive layer on the inner surface of the neck tube glass when the electron gun and the particle shielding element are introduced into the neck glass tube.

It is a further object of the present invention to provide a color cathode-ray tube in which a particle shielding element is provided between the neck tub glass and the electron gun to guard the electron gun against invasion of particles while preventing the generation of a high electric field at the contact between the particle shielding element and the neck glass tube.

The above objects can be achieved by designing particle shielding element such that the element has an outer diameter smaller than the inner diameter of an electroconductive layer on the inner peripheral surface of the neck tube glass when the particle shielding element is introduced together with the electron gun into the neck tube glass and such that, after the introduction of the particle shielding element into the neck tube glass, at least a part of the element is deformed by a temperature change into contact with the electroconductive layer. Preferably, the whole or at least a part of the particle shielding element can be formed of a shape memory metal. When the particle shielding element is initially fabricated, the element may have shape and size substantially similar to those which the element presents when the element is in its finally installed position in the cathode-ray tube. Then, the particle shielding element is deformed into shape and size which can be easily introduced into the neck tube glass of the cathode-ray tube to the finally installed position therein without any frictional contact with the electroconductive layer on the inner peripheral surface thereof. The particle shielding element may then be subjected to a temperature change so that the thus installed element recovers substantially to its initial shape and size to extend between the electroconductive layer and a shield cup whereby the gap between the neck tube glass and the shield cup is closed against invasion of particles into the electron gun.

The above and other objects, features and advantages of the present invention will be made more apparent by the following description with reference to the accompanying drawings.

DESCRIPTION OF PREFERRED EMBODIMENTS

Figure 1:
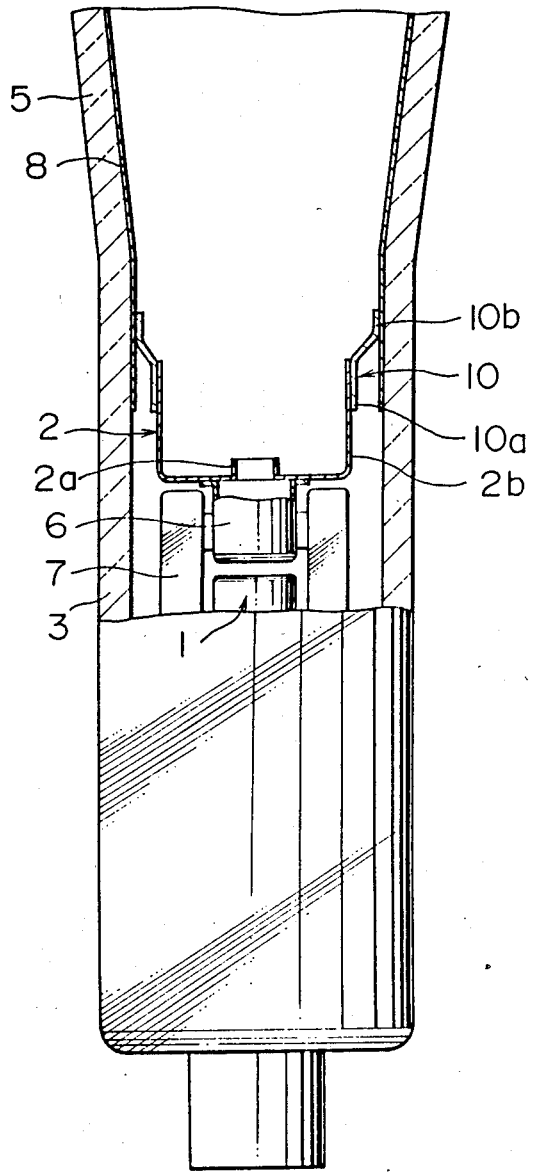
FIG. 1 is a partly sectional fragmentary side elevational view of an embodiment of a color cathode-ray tube according to the present invention.

Referring to FIG. 1 of the drawings, a color cathode-ray tube has a neck tube glass 3 integral with and connected to a funnel glass 5. The inner peripheral surface of the funnel glass 5 and a part of the neck tube glass 3 are coated with an electroconductive layer 8. An electron gun 1 is disposed in the neck tube glass 3 and includes an anode 6 supported by posts of support glass 7. The anode 6 has an open forward end connected with a bottom wall of a shield cup 2. A central opening 2*a* is formed in the bottom wall of the shield cup 2 and positioned coaxially with the anode 6. The shield cup 2 has a substantially cylindrical side wall 2*b* which is radially inwardly spaced a distance from the inner peripheral surface of the electroconductive coating layer 8 to define therewith an annular gap 9 which is closed by a generally frusto-conical particle shielding element 10 having a small-diameter end portion 10*a* fixed to and surrounding the outer peripheral surface of the cylindrical side wall 2*b* of the shield cup 2. The particle shielding element 10 extends from the small-diameter end portion 10*a* radially outwardly and forwardly to a large-diameter end portion 10*b* which is in electrically conductive contact with the inner peripheral surface of the electroconductive coating layer 8.

Figure 2:
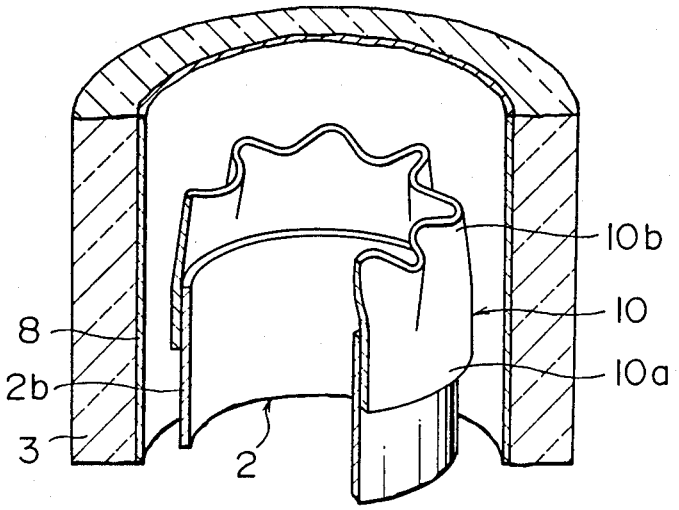
FIG. 2 is an enlarged, partly sectional and partly perspective fragmentary view of the cathode-ray tube shown in FIG. 1 with a particle shielding element shown in deformed and shrunk position.

The particle shielding element 10 is made of a shape memory metal. In the initial shape and size of the particle shielding element 10, the small-diameter end portion 10*a* of the element 10 has an inner diameter substantially the same a the outer diameter of the cylindrical side wall 2*b* of the shield cup 2 while the large-diameter end portion 10*b* of the particle shielding element 10 has an outer diameter substantially the same as or slightly greater than the inner diameter of the electroconductive coating layer 8. Before the particle shielding element 10 is introduced into the neck tube glass 3 of the cathode-ray tube, the large-diameter end portion 10*b* of the particle shielding element 10 is plastically deformed and shrunk from its initial shape and size shown in FIG. 3 to a shape having an outer diameter smaller than the inner diameter of the electroconductive coating layer 8, as will be clearly seen in FIG. 2, so that the element 10 can be freely introduced into the neck tube glass 3 without contacting the electroconductive coating layer 8. Thus, the insertion of the particle shielding element 10 into the neck tube glass 3 does not peel the electroconductive coating layer 8 and, therefore, does not produce any particles of the coating material of the electroconductive layer.

Figure 3:
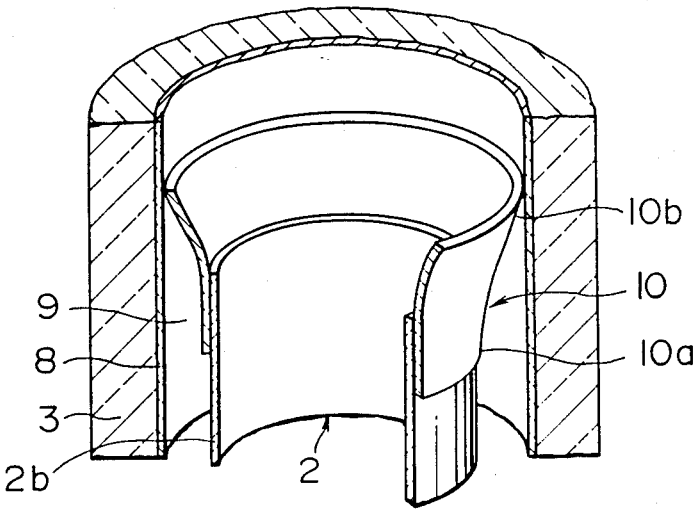
FIG. 3 is similar to FIG. 2 but shows the particle shielding element in its recovered position.

When the particle shielding element 10 has been introduced to a predetermined position in the neck tube glass 3 together with the electron gun 1, the temperature in the cathode-ray tube is adjusted from outside thereof so that the particle shielding element 10 recovers to the initial shape shown in FIG. 3. Thus, the particle shielding element 10 closes the annular gap 9 to guard the electron gun 1 against invasion of particles from the funnel glass 5. In addition, the large-diameter end portion 10*b* of the particle shielding element 10 is now in electrically conductive contact with the electroconductive coating layer 8, so that the latter is kept at an electrical potential the same as that of the shield cup 2. As a result, no electrical field is produced at the point of contact between the particle shielding element 10 and the neck tube glass.

The shape memory metal of the particle shielding element 10 may be selected from a Ni—Cr alloy, a Ni—Ti alloy, a Cu—Al alloy, a Cu—Zn alloy, a Cu—Zn—Al alloy and so forth. After a selected alloy has been shaped into the initial shape of the particle shielding element 10, the large-diameter end portion 10*b* thereof is plastically deformed to the shape shown in FIG. 2 by an external force applied to the large-diameter end portion, as will be described in more detail later.

Figure 4:
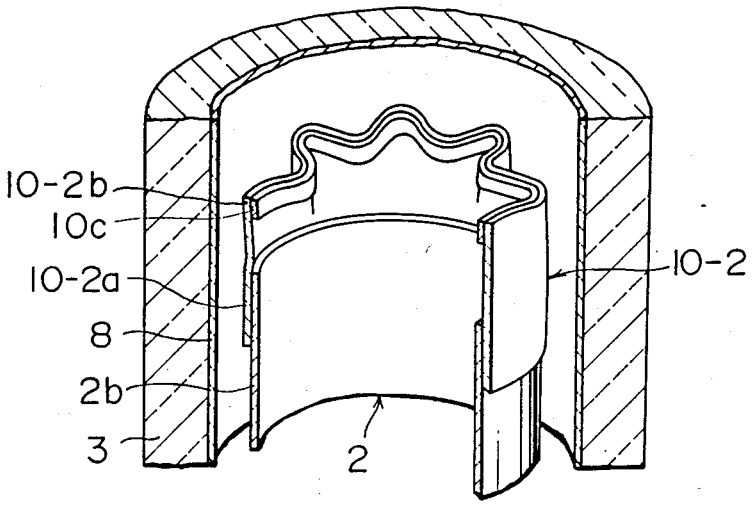
FIG. 4 is similar to FIG. 2 but illustrates a second embodiment of the cathode-ray tube according to the present invention with a particle shielding element shown in a deformed and shrunk position.
Figure 5:
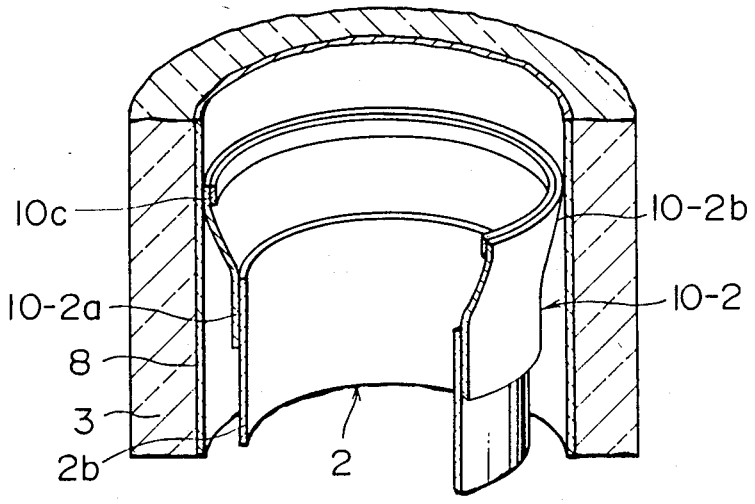
FIG. 5 is similar to FIG. 3 but illustrates the particle shielding element of the second embodiment in a recovered position.

FIGS. 4 and 5 show a second embodiment of the invention. This embodiment is distinguished from the preceding embodiment only in the point that a particle shielding element 10-2 is made of a substantially tubular foil 10-2*a* of a metal and a narrow strip 10*c* of a shape memory metal secured to the inner peripheral edge of the free end portion of the tubular metal foil 10-2*a*. The particle shielding element 10-2 has an initial shape shown in FIG. 5. Before the element 10-2 is inserted into the neck tube glass 3, the free end portion of the element 10-2 is plastically deformed into a shape shown in FIG. 4. After the element 10-2 has been introduced into the neck tube glass 3, the temperature in the cathode-ray tube is adjusted to allow the strip 10*c* of the shape memory metal to recover to the initial shape, with a result that the metal foil 10-2*a* follows the shape-recovery of the strip 10*c*. This embodiment is advantageous in that the use of the strip 10*c* of the shape memory metal greatly reduces the amount of the shape memory metal used to make the particle shielding element.

Figure 6:
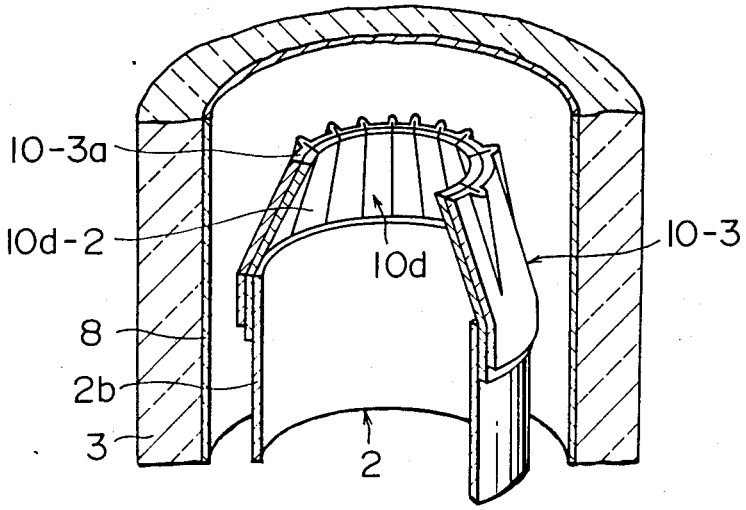
FIG. 6 is similar to FIG. 2 but illustrates a third embodiment of the invention with a particle shielding element shown in a deformed and shrunk position.
Figure 7:
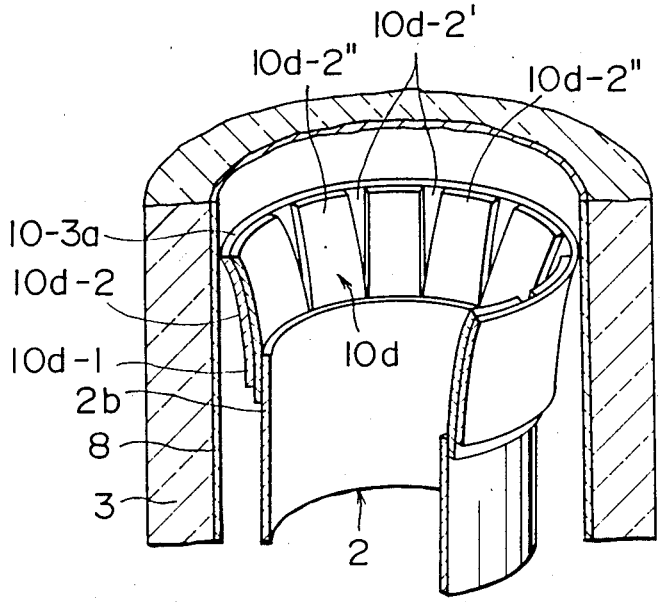
FIG. 7 is similar to FIG. 3 but illustrates the particle shielding element of the third embodiment in a recovered position.

A third embodiment of the invention is shown in FIGS. 6 and 7. This embodiment is distinguished from the second embodiment in that a particle shielding element 10-3 comprises a generally frusto-conical outer member 10-3*a* of a flexible foil of a metal and a generally frusto-conical inner member 10*d* of a shape memory metal, as best seen in FIG. 7. The inner member has one end secured to the outer peripheral surface of the cylindrical side wall 2*b* of the shield cup 2. The other end 10*d*-2 of the inner member 10 is outwardly flared and formed therein with circumferentially equally spaced triangular notches or slits 10*d*-2′ which divide the flared end 10*d*-2 into a plurality of circumferentially arranged generally rectangular segments 10*d*-2″. The outer flexible member 10-3*a* is secured to and surrounds the inner member 10*d*. Before the particle shielding element 10-3 is inserted into the neck tube glass, the other end 10*d*-2 of the inner member 10*d* is radially inwardly deformed and shrunk so that the rectangular segments of the other end 10*d*-2 abut each other, as will be seen in FIG. 6. The outer flexible member 10-3*a* is deformed or collapses radially inwardly, as shown in FIG. 6. After the particle shielding element 10-3 has been inserted into the neck tube glass, the temperature therein is adjusted to cause the inner member 10*d* of the shape memory metal to recover to its initial shape shown in FIG. 7. This embodiment of the invention also advantageously saves the amount of the shape memory metal.

Figure 8:
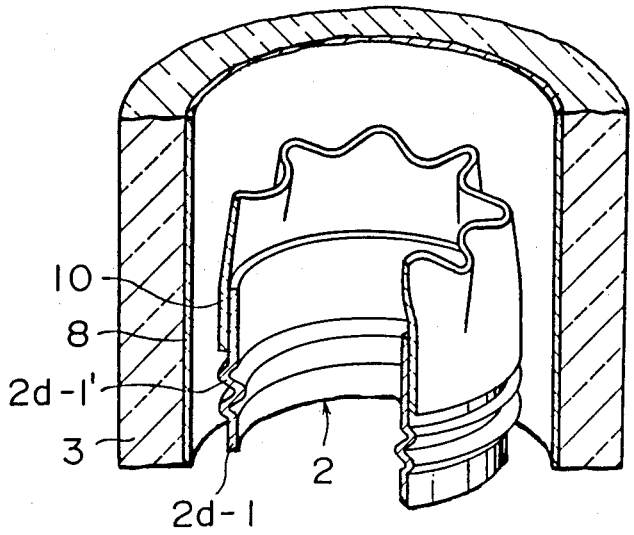
FIG. 8 is similar to FIG. 1 but illustrates a fourth embodiment of the invention.
Figure 9:
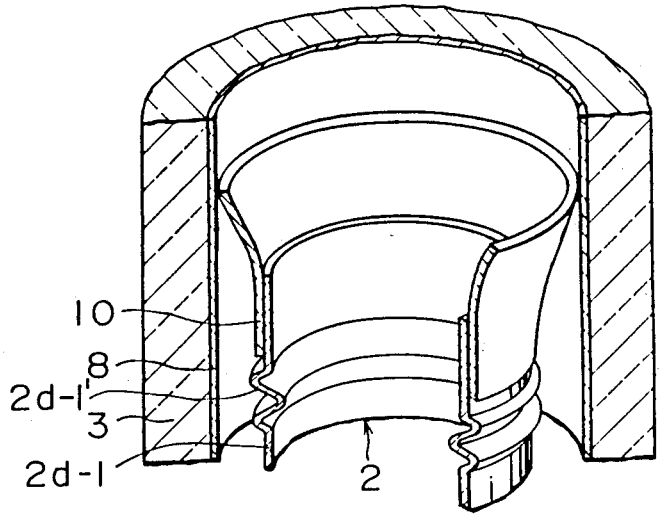
FIG. 9 is similar to FIG. 2 but illustrates a particle shielding element of the fourth embodiment in a deformed and shrunk position.
Figure 10:
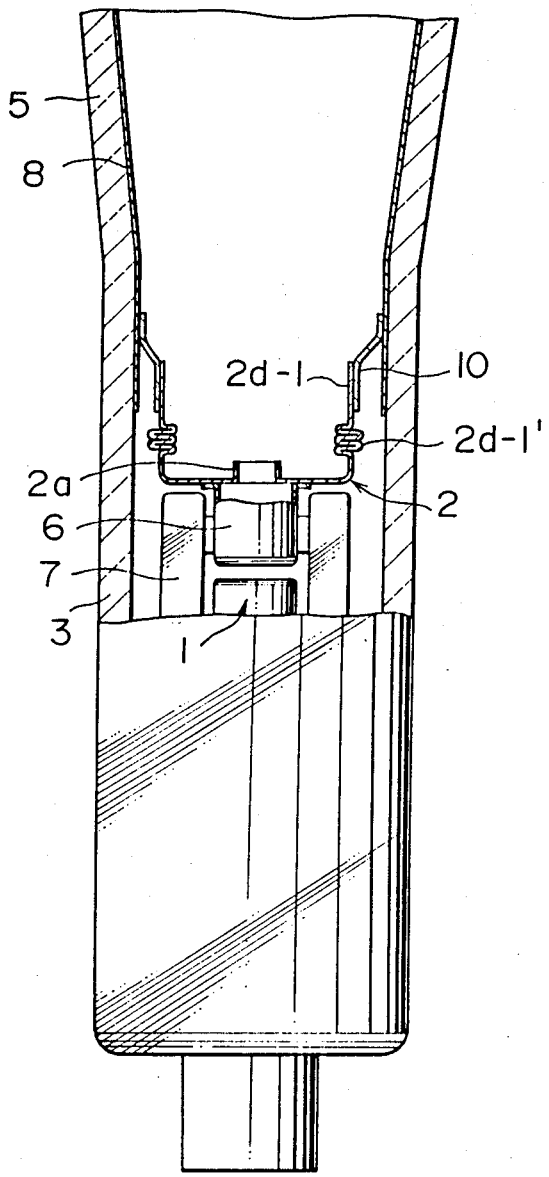
FIG. 10 is similar to FIG. 3 but illustrates the particle shielding element in a recovered position.

A fourth embodiment is shown in FIGS. 8–10. This embodiment is distinguished from the first embodiment shown in FIGS. 1–3 only in that the shield cup 2 has its cylindrical side wall 2*d*-1 corrugated at a portion, as shown by 2*d*-1′. This corrugated portion 2*d*-1′ advantageously acts as a shock absorber which guards the electron gun against a mechanical shock exerted to the cathode-ray tube. A particle shielding element 10 secured to the shield cup 2 is essentially identical with the particle shielding element employed in the first embodiment and, thus, guards the electron gun against invasion of particles.

As having been described above, the particle shielding element incorporated in each of the described and illustrated embodiments of the invention advantageously keeps the electron gun free from particles and dusts. Thus, the voltage resistance of the electron gun can be kept stable, so that the dark currents across the grid electrodes of the electron gun can always be kept below $10^{-9}$ Å.

Figure 11:
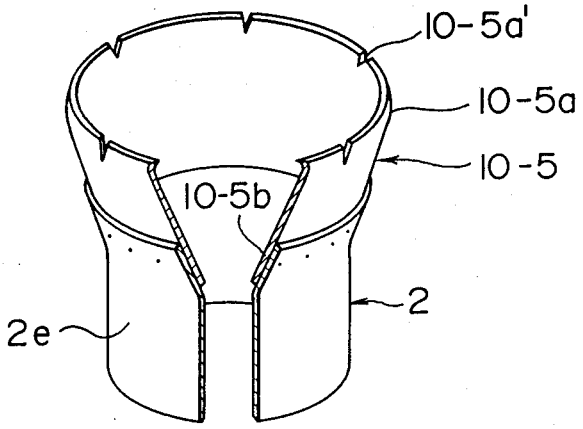
FIG. 11 is a perspective view of a particle shielding element and a shield cup both of a fifth embodiment of the invention with the particle shielding element and the shield cup both partly cut away.
Figure 12:
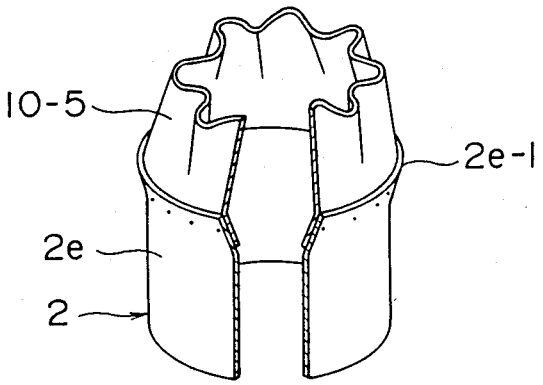
FIG. 12 is similar to FIG. 11 but illustrates the particle shielding element of the fifth embodiment in a deformed and shrunk position.
Figure 13:
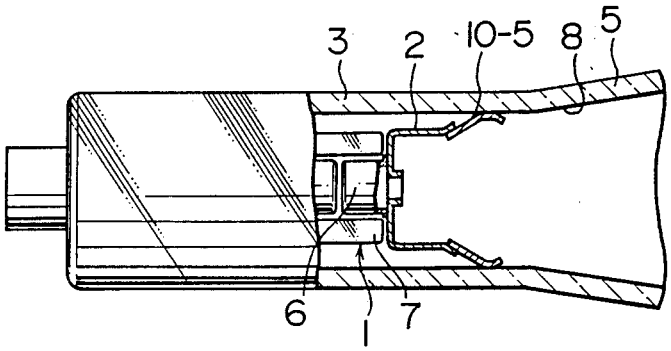
FIG. 13 is similar to FIG. 1 but illustrates the fifth embodiment of the cathode-ray tube with the particle shielding element and the shield cup shown in FIGS. 11 and 12 incorporated in the cathode-ray tube.

A fifth embodiment of the invention is shown in FIGS. 11–13. This embodiment is distinguished from the first embodiment shown in FIGS. 1–3 in that a particle shielding element 10-5 and the shield cup 2 are modified from those of the first embodiment. The modifications will be described hereinunder. The particle shielding element 10-5 is frusto-conical, as in the first embodiment of the invention, and has a large-diameter end portion 10-5*a* which is provided with a plurality of circumferentially spaced cuts 10-5*d*′ formed in the peripheral edge of the large-diameter end portion. The shield cup 2 has a substantially cylindrical side wall 2*a* having a radially outwardly diverging open end portion 2*e*-1 which snugly receives and is secured by, for example, welding, to a small-diameter end portion 10-5*b* of the particle shielding clement 10-5. The angle of inclination of the diverging end portion of the shield cup 2 is substantially the same as that of the small-diameter end portion 10-5*b* of the particle shielding element 10-5. Thus, the particle shielding element 10-5 can be brought into intimate contact with the inner peripheral surface of the diverging end portion 2*e*-1 of the shield cup 2 even if there are fluctuations of dimensions of the two members due to the allowable tolerances of manufacture. Before the two members are installed in position in the neck tube glass of the cathode-ray tube, the particle shielding member 10-5 is deformed and shrunk, as shown in FIG. 12. After the two members have been installed in the neck tube glass, the particle shielding member 10-5 is caused to restore to its initial shape with the large-diameter end portion expanded into contact with the electroconductive layer 8, as shown in FIG. 13. If the end extremity of the large-diameter end portion 10-5*a* is somewhat oversized due to allowable manufacturing tolerance, the cuts 10-5*a*′ formed in the peripheral edge of the large-diameter end portion 10-5*a* advantageously take up the excessive dimension of the end extremity of the expanded large-diameter end portion 10-5*a* to assure that this end portion can be in intimate engagement with the electroconductive layer on the inner peripheral surface of the cathode-ray tube.

Figure 14:
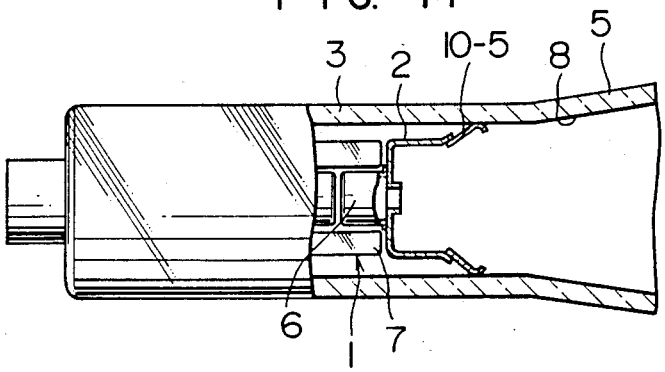
FIGS. 14–22 are respectively similar to FIG. 13 but illustrate sixth—fourteenth embodiments of the invention.

A sixth embodiment of the invention is shown in FIG. 14. This embodiment is distinguished from the preceding embodiment in that a particle shielding element 10-6 has a wall thickness which is varied such that the peripheral wall of the large-diameter end portion is thinned from a thicker wall of the smaller-diameter end portion. The thinned wall of the large-diameter end portion is resiliently flexible to advantageously eliminate the formation of folds and resiliently guard the electron gun against a mechanical shock exerted to the cathode-ray tube.

Figure 15:
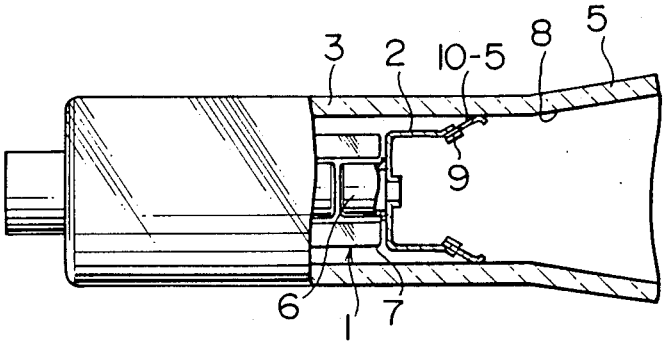

A seventh embodiment is shown in FIG. 15. This embodiment is distinguished from the fifth embodiment shown in FIG. 13 only in that a fixing ring 11 is employed to secure the particle shielding element 10-5 such that the latter is sandwiched between the shield cup 2 and the particle shielding element 10-5. The fixing ring is effective to not only increase the mechanical strength of the connection between the shield cup 2 and the particle shielding element 10-5 but also decrease the number of welding spots as compared with those required in the fifth embodiment shown in FIG. 13.

Figure 16:
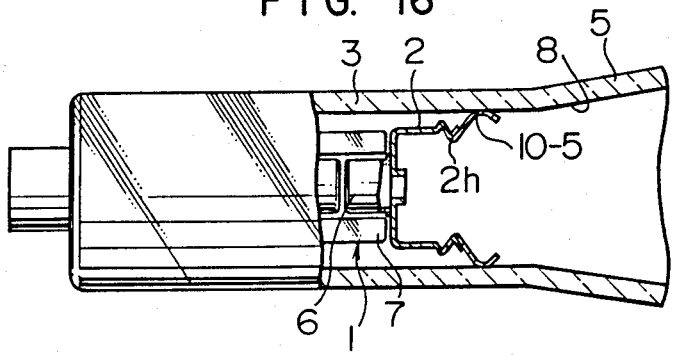

An eighth embodiment is shown in FIG. 16. This embodiment is distinguished from the fifth embodiment shown in FIG. 13 in that the cylindrical side wall of the shield cup 2 is corrugated at a portion 2*h* adjacent to the open end thereof. In this respect, therefore, this embodiment is similar to the fourth embodiment shown in FIG. 8 but is distinguished therefrom in that the eighth embodiment employs a particle shielding element 10-5 essentially the same as the particle shielding element employed in the fifth embodiment shown in FIG. 13.

Figure 17:
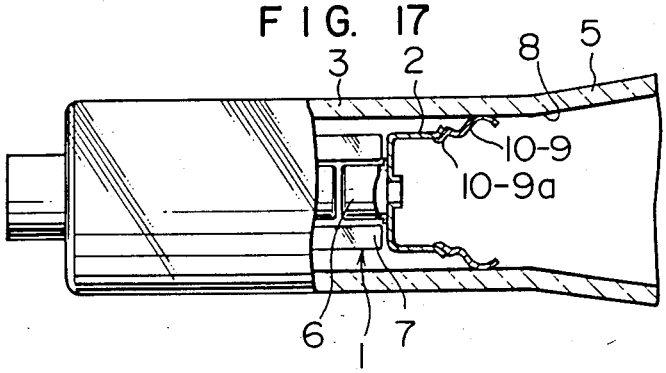

FIG. 17 shows a ninth embodiment of the invention. This embodiment is distinguished from the fifth embodiment shown in FIG. 13 in that a particle shielding element 10-9 is corrugated as at 10-9*a* adjacent to its small-diameter end to advantageously damp an external mechanical shock transmitted to the electron gun.

Figure 18:
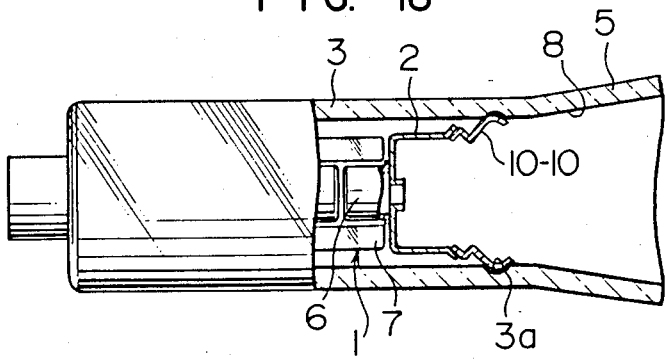

A tenth embodiment of the invention shown in FIG. 18 is modified such that a particle shielding element 10-10 is basically similar to the particle shielding element of the fifth embodiment shown in FIGS. 11–13 with an exception that the cuts 10-5*a*′ (see FIG. 11) are not formed in the peripheral edge of the opening in the large-diameter end of the particle shielding element 10-10 of the tenth embodiment. Instead, the inner peripheral surface of the neck glass tube 3 is formed therein with an annular recess or groove 3-*a* with which the large-diameter end portion of the particle shielding element 10-10 is engaged, whereby an intimate contact between the particle shielding element 10-10 and the neck glass tube 3 is assured.

Figure 19:
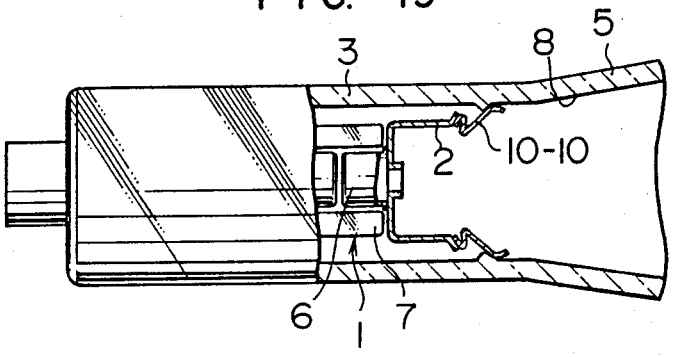

FIG. 19 shows an eleventh embodiment of the invention which is distinguished from the tenth embodiment in that the inner peripheral surface of the neck glass tube 3 is formed thereon with an annular projection 3-*b* rather than the annular recess 3-*a*. The annular projection 3-*b* advantageously assures an intimate contact between the inner peripheral surface of the electroconductive layer 8 and the large-diameter end portion of a particle shielding element 10-10. The particle shielding element employed in the eleventh embodiment may be similar in structure to the particle shielding element 10-10 employed in the tenth embodiment shown in FIG. 18.

Figure 20:
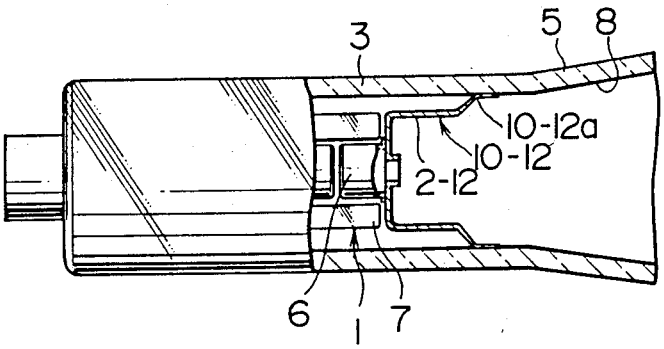

A twelfth embodiment shown in FIG. 20 has a shielding element 10-12 of a shape memory metal secured to the electron gun and including a shield cup section 2-12 and a particle shielding section 10-12*a* integral therewith. The integral design is effective to eliminate the manufacturing step of securing the particle shielding element to the shield cup required in other embodiments of the invention.

Figure 21:
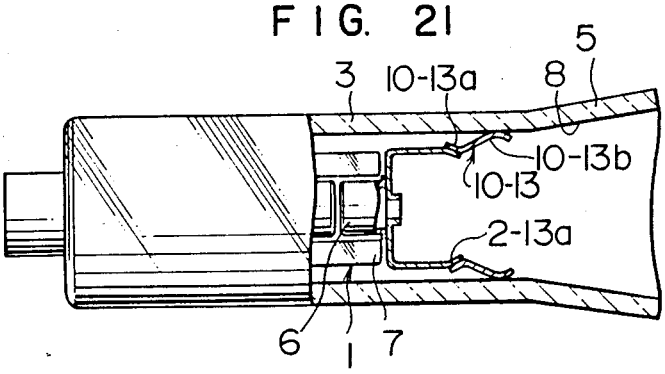

FIG. 21 shows a thirteenth embodiment of the invention in which a shield cup 2-13 has a radially inwardly and forwardly converging open end portion 2-13*a*. A particle shielding element 10-13 of a shape memory metal has a small-diameter end portion 10-13*a* which is radially outwardly and rearwardly diverging from a frusto-conical body 10-13*b* of the particle shielding element and is secured to the outer peripheral surface of the converging open end portion 2-13*a* of the shield cup 2-13. The provision of the radially outwardly and rearwardly diverging small-diameter end portion 10-13*a* on the particle shielding element 10-13 provides the element 10-13 with a curved or bent junction between the end portion 10-13*a* and the body 10-13*b*. This junction is operative to damp an external mechanical shock transmitted to the electron gun.

Figure 22:
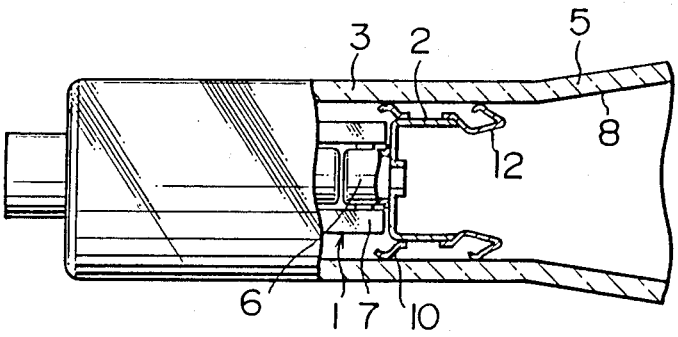

FIG. 22 shows a fourteenth embodiment of the invention in which a particle shielding element 10, which is substantially identical with the particle shielding element 10 employed in the first embodiment, is secured at its small-diameter end portion to the outer peripheral surface of the cylindrical side wall section of the shield cup 2 adjacent to the bottom wall thereof such that the large-diameter end portion of the particle shielding element 10 is directed rearwardly of the cathode-ray tube. A bulb-spacer 12 is secured at its one end to the open end of the shield cup 2 and engaged with the electroconductive layer 8 on the inner surface of the funnel tube glass 5 to radially support the electron gun from the funnel tube glass 5. Accordingly, the particle shielding element 10 is not required to have a mechanical strength to support the electron gun and, therefore, can have a wall thickness which is required only to operate to shield the electron gun against invasion of particles. The particle shielding element 10 can therefore be made at a decreased cost.

Figure 23:
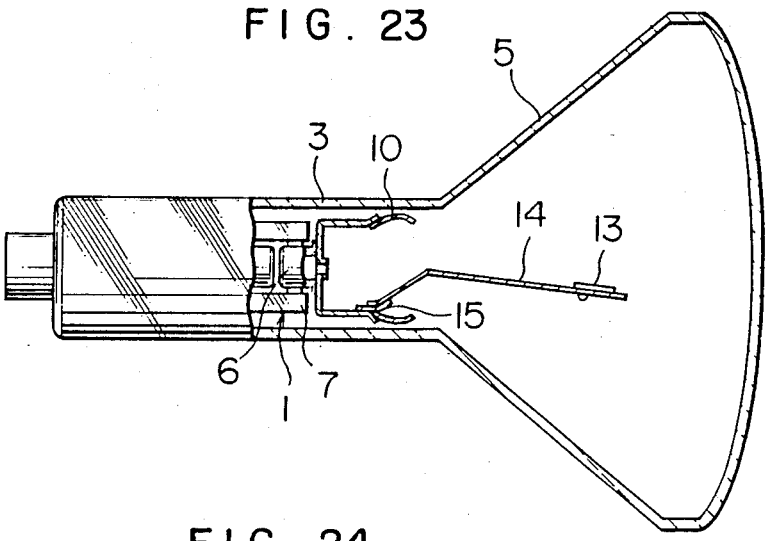
FIG. 23 is a partly sectional side elevation of a fifteenth embodiment of a cathode-ray tube of the present invention with a particle shielding element shown in a deformed and shrunk position.
Figure 24:
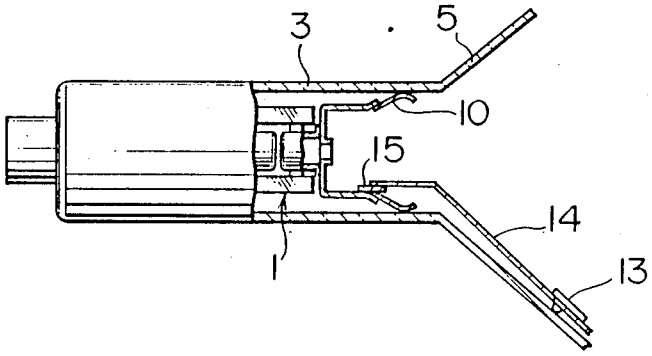
FIG. 24 is a partly sectional fragmentary side elevation of the cathode-ray tube of the fifteenth embodiment of the invention with the particle shielding element shown in a recovered position.

FIGS. 23 and 24 show a fifteenth embodiment of the invention in which a getter 13 is disposed in the cathode-ray tube and connected to a forward end of a getter spring 14. The other or rearward end of the getter spring 14 is connected via a plate member 15 of a shape memory metal to a particle shielding element 10 which in turn is secured to a shield cup 2 of the electron gun 1. The particle shielding element 10 may be substantially identical to the particle shielding element 10 employed in the first embodiment of the invention. Before an assembly of the electron gun 1, the particle shielding element 10, the getter 13, the getter spring 14 and the plate member 15 is inserted into a neck glass tube 3, the particle shielding element 10 is deformed and shrunk radially inwardly, as in the preceding embodiments of the invention, and the plate member 15 of a shape memory metal is also deformed so that the getter 13 is moved to a position substantially axially aligned with the shield cup 2, as will be seen in FIG. 23. The assembly is then introduced into the neck glass tube 3. It will be appreciated that neither the particle shielding element 10 nor the getter spring 14 scratches the electroconductive layer 8 during the movement of the assembly into the neck glass tube 3. The particle shielding element 10 and the plate member 15 of shape memory metal are subjected to a temperature change so that they recover to their initial shapes shown in FIG. 24 in which the particle shielding element 10 is engaged at its large-diameter end with the electroconductive layer 8 and the getter spring 14 extends substantially parallel to the inner surface of the funnel glass 5 to place the getter 13 in contact with the electroconductive layer 8 on the inner surface of the funnel glass.

Referring now to FIGS. 25–33, a description will be made of a method of making the particle shielding element 10-5 described mainly with reference to FIGS. 11–13. It is, however, to be understood that the method is also applicable to the fabrication of the particle shielding elements employed in the other embodiments of the invention described hereinabove.

Figure 25:
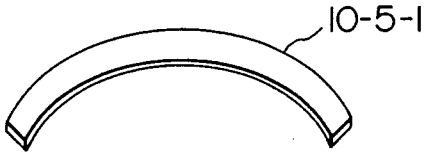
FIGS. 25–33 illustrate the steps of making the particle shielding element of the fifth embodiment shown in FIG. 11.
Figure 26:
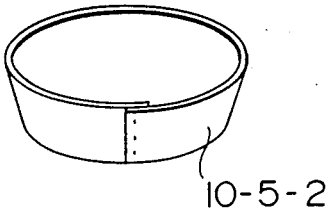
Figure 26:
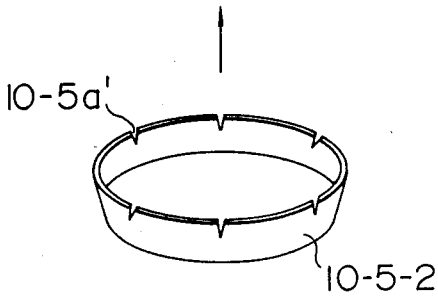

An arcuate blank 10-5-1 shown in FIG. 25 is prepared from a sheet of a shape memory metal, not shown. The blank 10-5-1 is then circularly bent and the circumferential ends of the thus bent arcuate blank are welded together to form a frusto-conical preform 10-5-2, as shown in FIG. 26. A plurality of notches or cuts 10-5*a*′ shown in FIG. 11 are then formed in the annular end face of the large-diameter end of the preform 10-5-2, as shown in FIG. 27.

Figure 27:
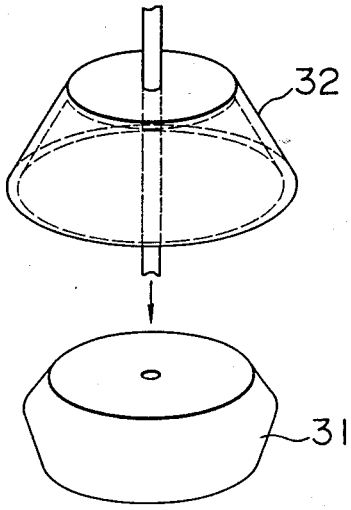
Figure 28:
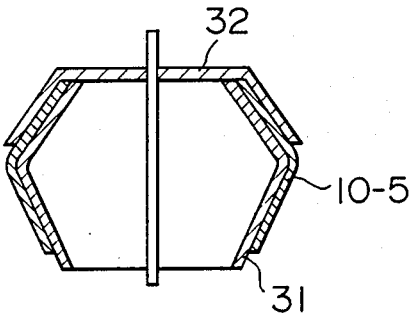

A first pair of male and female formers 31 and 32 shown in FIGS. 27 are prepared for shaping the preform 10-5-2 into an initial shape of a particle shielding element. The preform 10-5-2 is placed and pressed between the male and female formers 31 and 32 so that the preform is now shaped into the initial shape of the particle shielding element 10-5, as shown in FIG. 28, and then subjected to a shape-memory treatment. The initial shape of the particle shielding element 10-5 has a large-diameter end which is radially inwardly bent or curved from a largest-diameter portion which is rounded in an axial section, as will be seen in FIG. 28.

Figure 29:
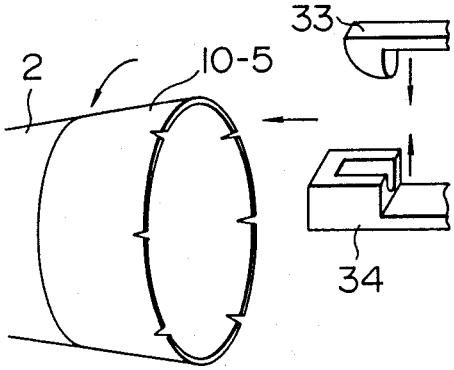

The particle shielding element 10-5 is then deformed and shrunk at its section adjacent to the large-diameter end into a secondary shape shown in FIG. 12 by means of a second pair of male and female formers 33 and 34 shown in FIG. 29. The pair of formers 33 and 34 resemble nippers and, therefore, must be repeatedly operated to deform the particle shielding element 10-5 to form corrugations along the periphery of the large-diameter end portion of the particle shielding element 10-5.

Figure 30:
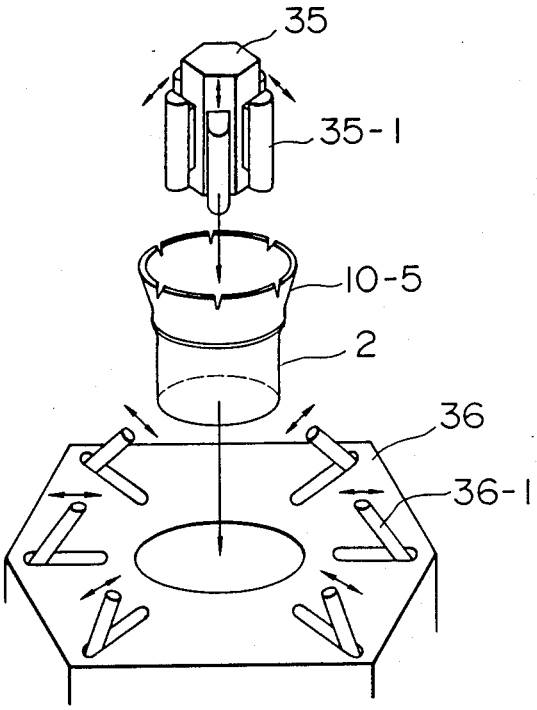
Figure 31:
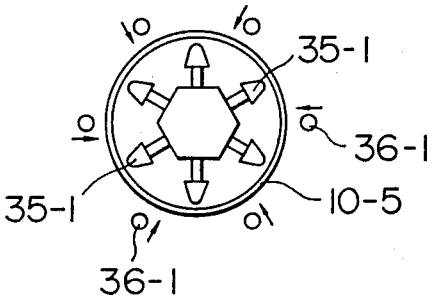
Figure 32:
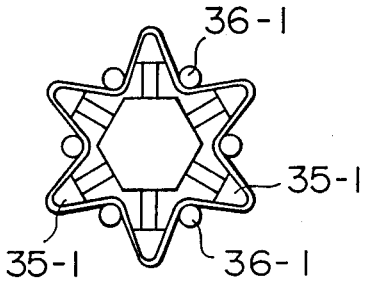
Figure 33:
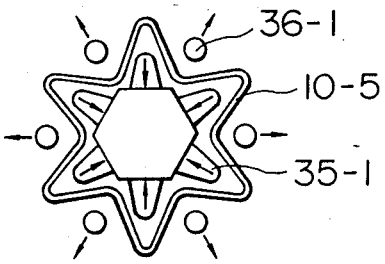

The deforming steps can be simplified by making use of an improved pair of male and female formers 35 and 36 shown in FIG. 30. A particle shielding element 10-5 is first secured at its small-diameter end portion to a shield cup 2. Then, the pair of male and female formers 35 and 36 are placed inside and outside the particle shielding element 10-5, as shown in FIG. 31. The male former 35 has a plurality of radially movable forming arms 35-1, while the female 36 has a plurality of radially movable forming arms 36-1, as best shown in FIG. 31. The male and female formers 35 and 36 are set relative to the particle shielding element 10-5 such that the forming arms 35-1 and the forming arms 36-1 are staggered circumferentially of the particle shielding element 10-5. The forming arms 36-1 are then driven radially inwardly to urge the large-diameter end portion of the particle shielding element 10-5 radially inwardly, as indicated by arrows X shown in FIG. 31, while the forming arms 35-1 and the male former 35 are kept stationary until the particle shielding element is deformed and shrunk or collapses, as shown in FIG. 32. Thereafter, the forming arms 35-1 of the male former 35 are moved radially inwardly while the forming arms 36-1 of the female former 36 are moved radially outwardly as shown in FIG. 33. The particle shielding element 10-5 thus deformed is then removed out of the pair of formers 35 and 36.

FIGS. 34–41 show sixteenth to twenty-first embodiments of the invention. These embodiments are basically similar in that particle shielding elements employed in these embodiments are formed of coiled rods or wire-like strips of a shape memory metal.

Figure 34:
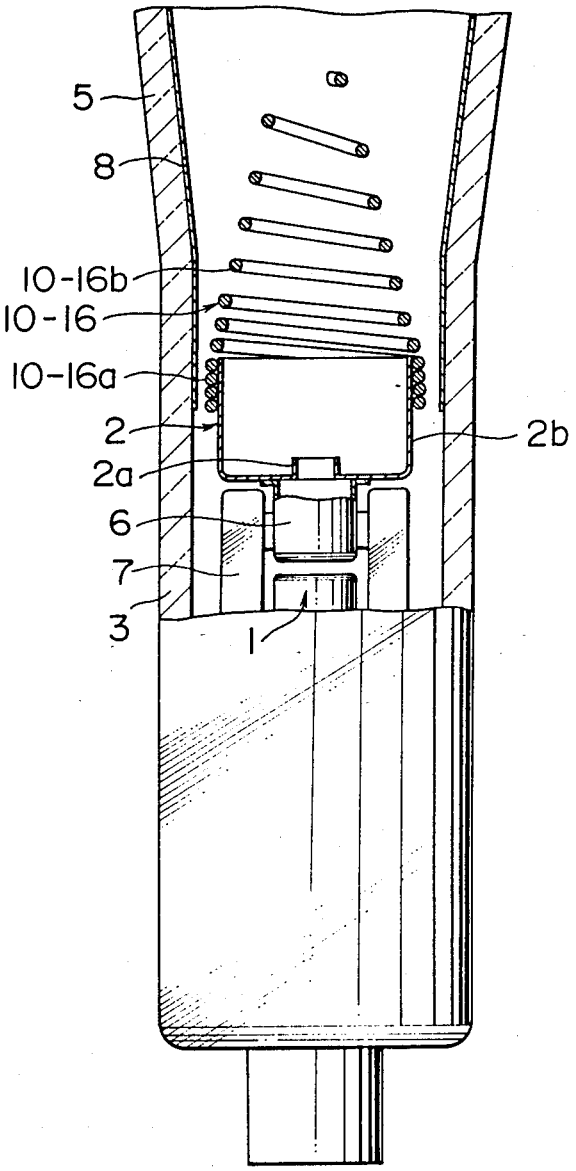
FIG. 34 is similar to FIG. 1 but illustrates a sixteenth embodiment of the invention with a particle shielding element shown in deformed and shrunk position.
Figure 35:
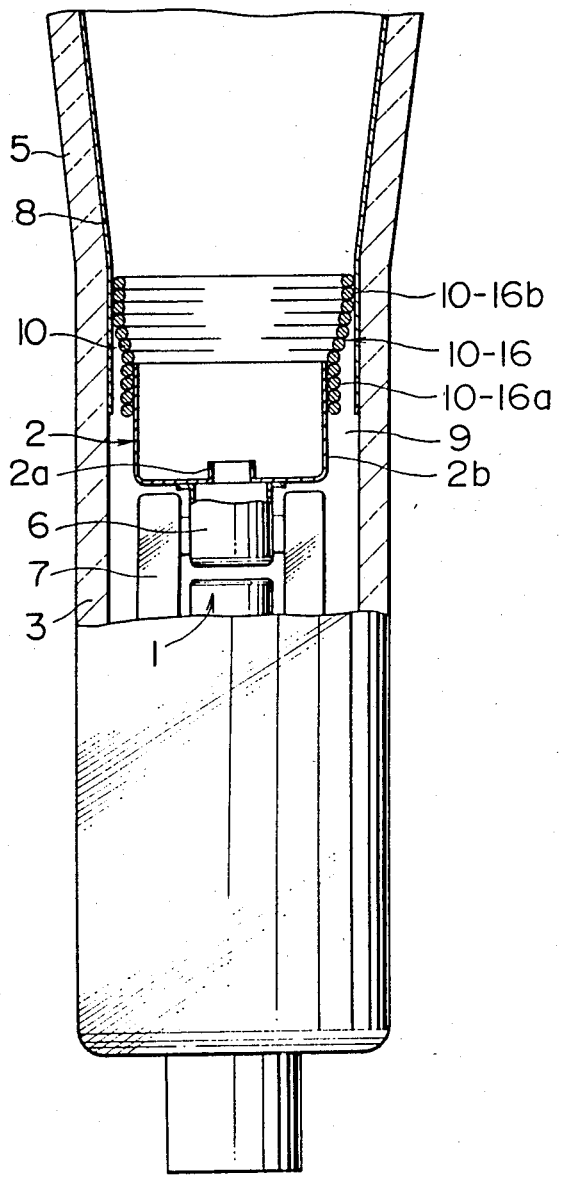
FIG. 35 is similar to FIG. 34 but shows the particle shielding element in its recovered position.

In the sixteenth embodiment shown in FIGS. 34 and 35, a particle shielding element 10-16 comprises a plurality of turns of a coiled rod of a shape memory metal. The turns of the coil are disposed in side-by-side intimate contact with each other to form a hollow and substantially frusto-conical wall having a small-diameter end portion **10-16*a* secured to the cylindrical outer peripheral surface of a shield cup 2 and a large-diameter end portion 10-16*b* engaged with the inner peripheral surface of the electroconductive layer 8 on the inner surface of the neck glass tube 3 to close the annular gap 9 between the shield cup 2 and the inner peripheral surface of the neck glass tube 3, as shown in FIG. 35. Before the particle shielding element 10-16 is installed in position in the neck glass tube 3 as shown in FIG. 35, the large-diameter end portion 10-16*b* is stretched axially of the turns of the coil to reduce the outer diameter of the large-diameter end portion 10-16*b*, as shown in FIG. 34, so that the large-diameter end portion 10-16*b* does not scratch the electroconductive layer 8 when the element 10-16 is inserted into the neck tube glass 3. After the element 10-16 has been installed in position in the neck tube glass 3, the temperature in the cathode-ray tube is controlled to cause the large-diameter end portion 10-16*b* of the element to recover to the initial shape shown in FIG. 35**.

In the manufacture of cathode-ray tubes, an electron gun is inserted into a neck glass tube of each cathode-ray tube at a normal or ambient temperature. Thereafter, various steps are conducted such as sealing of the neck glass tubes, vacuum-evacuation of cathode-ray tubes, knocking, aging and various tests. Then, the cathode-ray tubes are stored and, thereafter, delivered. In the course of the successive steps and storing, the temperature in the vicinity of the shield cup of the electron gun of each cathode-ray tube is varied within a range of from the room temperature to 300° C. which is reached in the vacuum-evacuation step. By setting a range of from 10° C. to 300° C. as a temperature range within which the particle shielding elements of the shape memory metal can maintain their deformed and shrunk shapes, and by setting a range of above 300° C. or below 0° C. as a temperature range within which the deformed particle shielding elements can recover to their initial shapes, an advantage is obtained that the vacuum-evacuation step can be conducted without any adverse influence. Particularly, by setting a range of below 0° C. as the temperature range within which the deformed and shrunk particle shielding elements can recover to their initial shapes, the deformation treatment of the particle shielding elements in cathode-ray tubes can be performed during their storage in a storehouse. Alternatively, the temperature range within which the deformed particle shielding elements can recover to their initial shapes can be set to be from 50° C. to 80° C., which is lower than the operation temperature of cathode-ray tubes, to provide an advantage that the deformed particle shielding elements can recover to their initial shapes by themselves, i.e., without any positive heating step.

Figure 36:
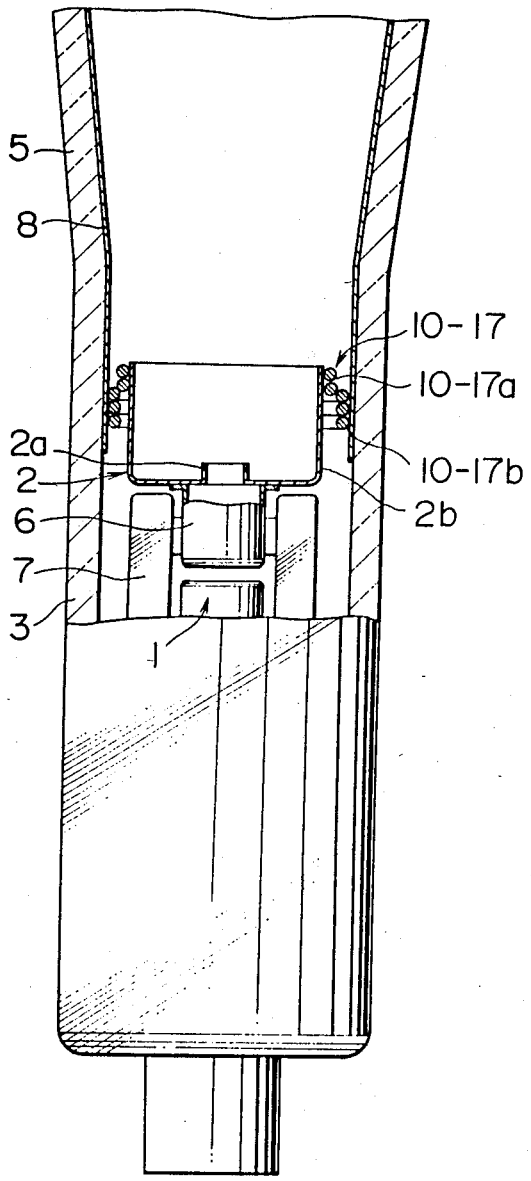
FIG. 36 is similar to FIG. 34 but illustrates a seventeenth embodiment of the invention with a particle shielding element shown in recovered position.

In the seventeenth embodiment shown in FIG. 36, a particle shielding element 10-17 is also formed by turns of a coiled rod of a shape memory metal and has a small-diameter end **10-17*a* secured to the outer peripheral surface of a cylindrical side wall portion 2*b* of a shield cup 2 and a large-diameter end 10-17*b* which is directed rearwardly of the cathode-ray tube towards the electron gun 1 thereof and engaged with the inner peripheral surface of an electroconductive layer 8. Before the particle shielding element 10-17 is inserted into the neck glass tube 3, the large-diameter end 10-17*b* has its outer diameter smaller than the inner diameter of the electroconductive coating layer 8 and, thus, does not scratch the layer 8 when the element 10-17 is inserted into the neck glass tube 3**. The turns of the coil are in side-by-side contacting relationship with each other to guard the electron gun against invasion of particles.

Figure 37:
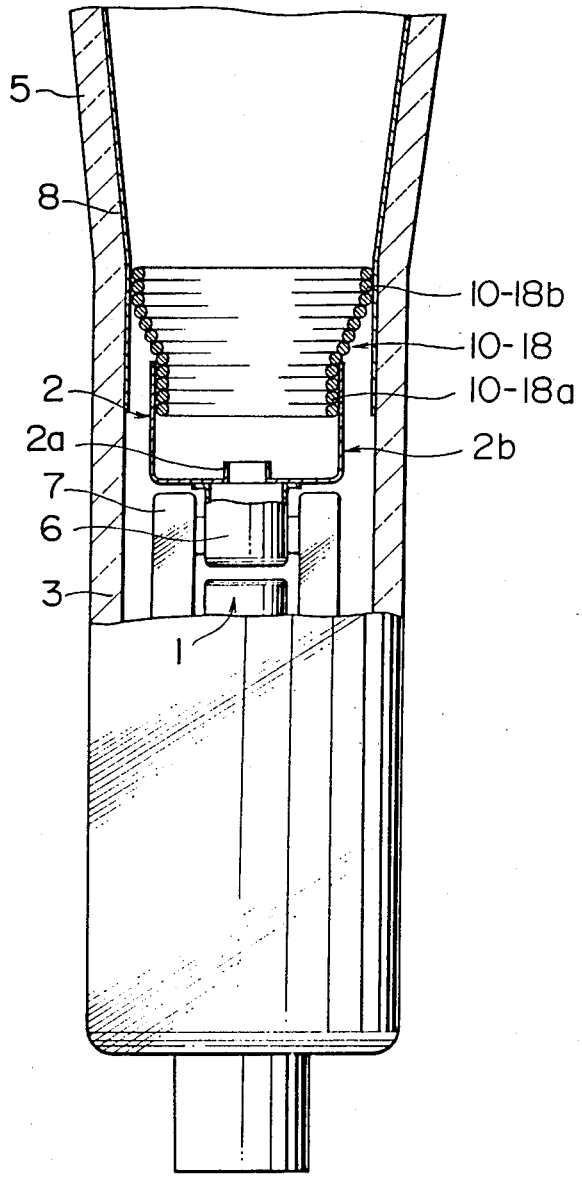
FIG. 37 is similar to FIG. 34 but illustrates an eighteenth embodiment of the invention with a particle shielding element shown in recovered position.

The eighteenth embodiment shown in FIG. 37 has a generally frusto-conical particle shielding element 10-18 formed of turns of a coiled rod of a shape memory metal and having a small-diameter end 10-18a secured to the inner peripheral surface of a cylindrical side wall portion **2*b* of a shield cup 2 and a large-diameter end portion 10-18*b* diverging radially outwardly and forwardly of the cathode-ray tube into contact with the inner peripheral surface of the electroconductive layer 8**. The turns of the coil are in contact with each other to block invasion of particles into the electron gun.

Figure 38:
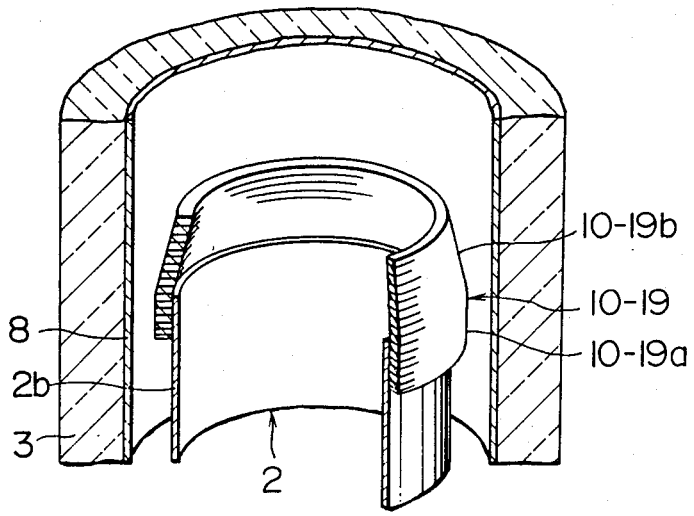
FIG. 38 is similar to FIG. 2 but illustrates a particle shielding element of a nineteenth embodiment of the invention in a deformed and shrunk position.
Figure 39:
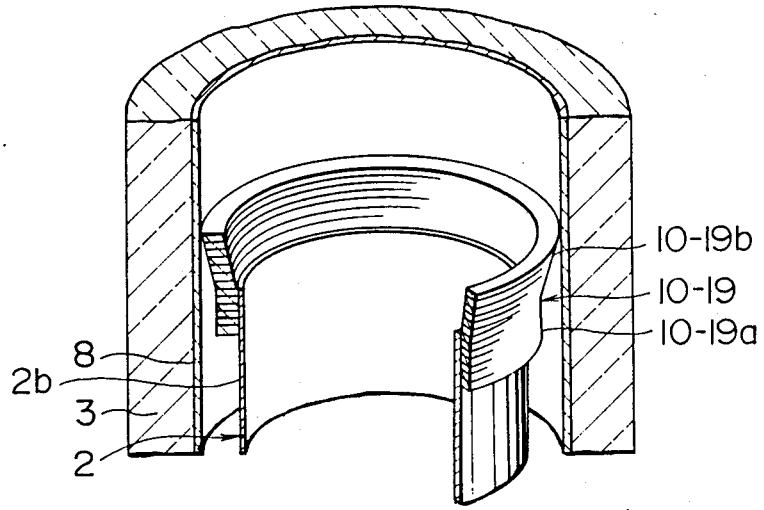
FIG. 39 is similar to FIG. 38 but illustrates the particle shielding element in its recovered position.

A nineteenth embodiment of the invention shown in FIGS. 38 and 39 has a particle shielding element 10-19 made of a plurality of turns of coiled rod of a shape memory metal having a generally rectangular cross-section. The element 10-19 is generally frusto-conical and has a small-diameter end portion 10-19*a* secured to the outer peripheral surface of a cylindrical side wall portion 2*b* of a shield cup 2 and a large-diameter end portion 10-19*b* diverging radially outwardly and forwardly of the cathode-ray tube into contact with the inner peripheral surface of an electroconductive layer 8, as shown in FIG. 39. Before the particle shielding element 10-19 is inserted into a neck tube glass 3, the large-diameter end portion 10-19*b* is deformed to reduce its outer diameter, as shown in FIG. 38. After the particle shielding element 10-19 is inserted into the neck glass tube 3, the element is caused to recover to its initial shape shown in FIG. 39. In this state of the element 10-19, the turns of the coiled rod of the shape memory metal are arranged such that the planar axial end faces of each turn of the coil are in face-to-face contacting relationship to and overlapped with similar axial end faces of adjacent turns of coil so that the turns of the coil form a substantially continuous frusto-conical wall which is operative to close the annular gap between the electroconductive layer 8 and the cylindrical side wall portion 2*b* of the shield cup 2, whereby the electron gun is sealed against invasion of particles. The turns of the coil should overlap with each other over at least 10% of the length of the long sides of the rectangular cross-section of the rod to assure that the turns of coil are not dislodged one from another.

Figure 40:
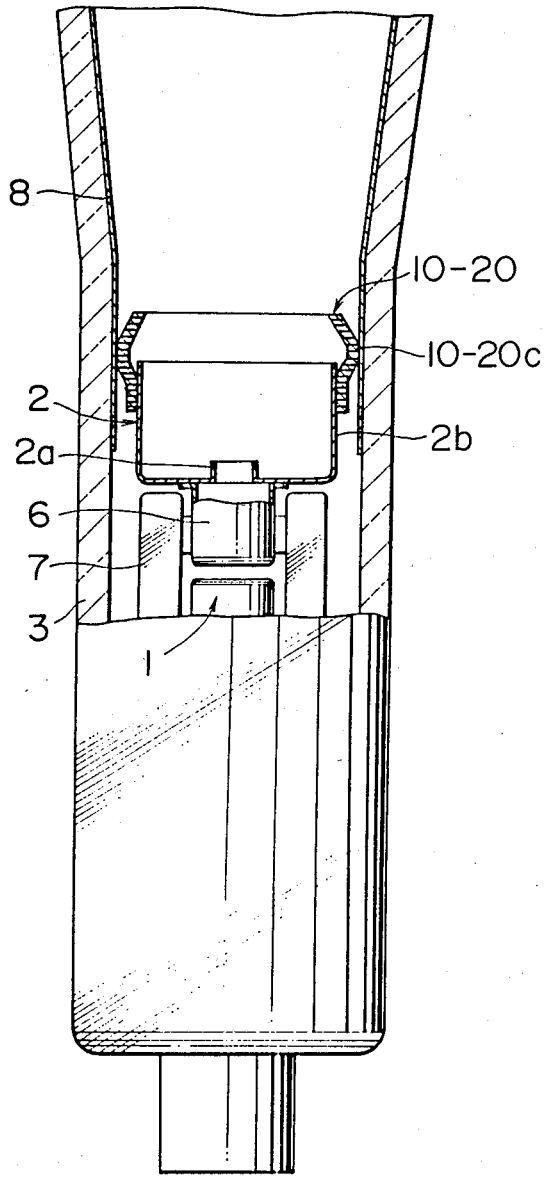
FIG. 40 is similar to FIG. 37 but illustrates a twentieth embodiment of the invention with a particle shielding element in a recovered position.

The twentieth embodiment shown in FIG. 40 has a particle shielding element 10-20 which is modified from the particle shielding element 10-19 of the preceding embodiment such that the modified element 10-20 has the largest outer diameter at an intermediate portion 10-20*c* disposed in contact with an electroconductive layer 8 on the inner peripheral surface of a neck glass tube 3.

Figure 41:
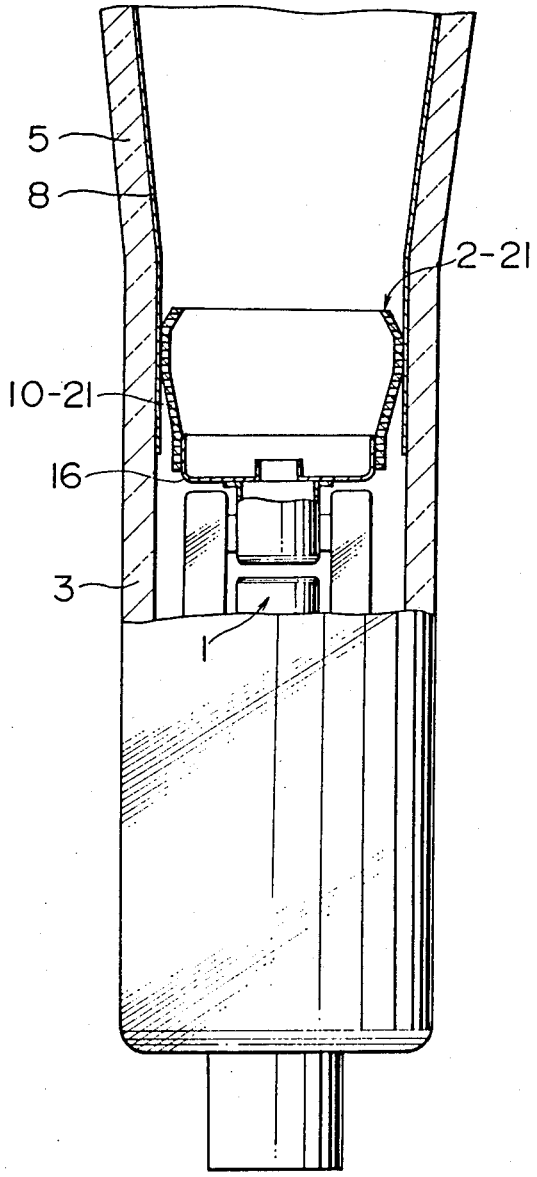
FIG. 41 is similar to FIG. 40 but illustrates a twenty-first embodiment of the invention.
Figure 42:
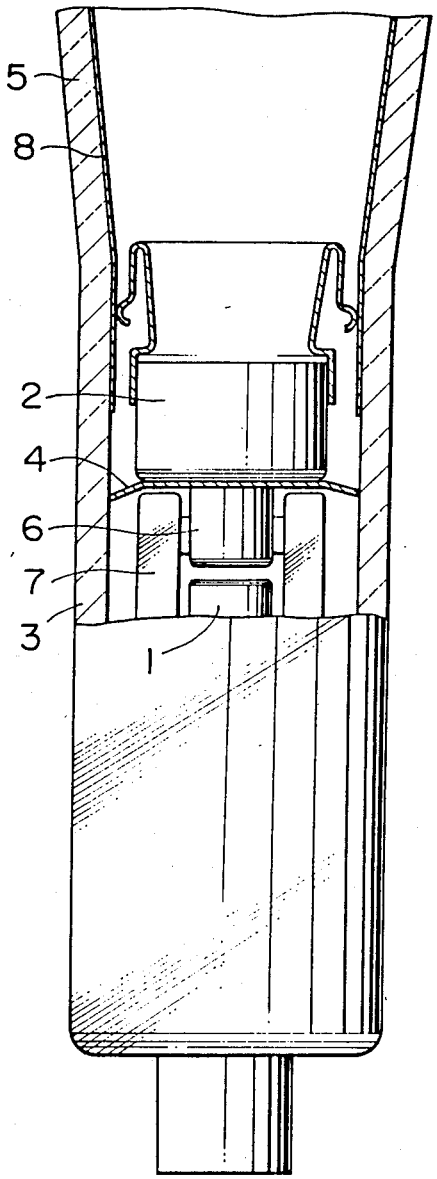
FIG. 42 PRIOR ART
FIG. 42 illustrates the cathode-ray tube of the prior art discussed hereinabove.

In a twenty-first embodiment shown in FIG. 41, a particle shielding element 10-21, which is somewhat similar to the particle shielding element 10-20 of the preceding embodiment, is united with a lower electrode 16 to form a shield cup 2-21.

What is claimed is:

1. A cathode-ray tube comprising a neck glass tube having an inner peripheral surface coated with an electroconductive layer, an electron gun including a shield cup having an outer peripheral surface radially inwardly spaced from said electroconductive layer and cooperating therewith to define therebetween a gap, and a particle shielding element extending between said shield cup and said electroconductive layer to close said gap to thereby guard said electron gun against invasion of particles, said particle shielding element having a radially outer portion disposed in contact with said electroconductive layer, at least a part of said particle shielding element being formed from a shape memory metal, said particle shielding element having been deformed to an outer diameter smaller than an inner diameter of said electroconductive layer before said particle shielding element is installed in position in said neck glass tube, to thereby allow said particle shielding element to be inserted into said neck glass tube without scratching said electroconductive layer.

2. A cathode-ray tube according to claim 1, wherein said particle shielding element is hollow and generally frusto-conical and has a small-diameter portion secured to said shield cup and a large-diameter portion contacting said electroconductive layer, said large-diameter portion having been deformed to said outer diameter before said particle shielding element is inserted into said neck glass tube.

3. A cathode-ray tube according to claim 2, wherein said particle shielding element is wholly formed from said shape memory metal.

4. A cathode-ray tube according to claim 2, wherein said particle shielding element comprises a hollow and substantially frusto-conical member of a flexible foil of a metal and a strip of a shape memory metal secured to said frusto-conical member along a periphery of an opening of said large-diameter portion thereof.

5. A cathode-ray tube according to claim 2, wherein said particle shielding element comprises a hollow and generally frusto-conical inner member of a shape memory metal having a small diameter portion secured to said shield cup and a radially outwardly flared large-diameter portion provided with slits formed and opened in a peripheral edge portion of said large-diameter portion to divide said flared large-diameter portion a plurality of circumferentially arranged segments, and a generally frusto-conical outer member of a flexible foil of a metal secured to and surrounding said inner member.

6. A cathode-ray tube according to claim 1, wherein said shield cup includes a substantially cylindrical side wall at least a part of which is corrugated to provide said shield cup with a resiliency.

7. A cathode-ray tube according to claim 2, wherein said shield cup has a substantially cylindrical side wall and said particle shielding element is hollow and substantially frusto-conical and has a small-diameter end portion secured to said cylindrical side wall of said shield cup and a large-diameter end portion disposed in electroconductive contact with said electroconductive layer, said large-diameter end portion having been deformed and shrunk to said outer diameter before said particle shielding element is inserted into said neck glass tube.

8. A cathode-ray tube according to claim 7, wherein said particle shielding element is structured to provide said large-diameter end portion with a resiliency.

9. A cathode-ray tube according to claim 8, wherein said large-diameter end portion is provided with cuts formed in a peripheral edge of said large-diameter end portion to provide said large-diameter end portion with a resiliency.

10. A cathode-ray tube according to claim 8, wherein said large-diameter end portion of said particle shielding element has a wall thickness smaller than that of said small-diameter end portion.

11. A cathode-ray tube according to claim 7, further including a fixing ring for securing said small-diameter end portion of said particle shielding element to said shield cup.

12. A cathode-ray tube according to claim 7, wherein said particle shielding element is corrugated to provide said small-diameter end portion with a resiliency.

13. A cathode-ray tube according to claim 7, wherein the inner peripheral surface of said neck glass tube is formed therein with an annular recess with which said large-diameter end portion of said particle shielding element is engaged.

14. A cathode-ray tube according to claim 7, wherein the inner peripheral surface of said neck glass tube is formed thereon with an annular projection with which said large-diameter end portion of said particle shielding element is engaged.

15. A cathode-ray tube according to claim 7, wherein said particle shielding element is integral with said shield cup.

16. A cathode-ray tube according to claim 7, wherein said large-diameter end portion has a radially inwardly converging end extremity while said small-diameter end portion has a radially outwardly diverging end extremity.

17. A cathode-ray tube according to claim 7, wherein said particle shielding element is positioned such that said large-diameter end portion is directed forwardly of the cathode-ray tube.

18. A cathode-ray tube according to claim 7, wherein said particle shielding element is positioned such that said large-diameter end portion is directed rearwardly of said cathode-ray tube.

19. A cathode-ray tube according to claim 7, further including a getter spring, a getter attached to an end of said getter spring, and a member of a shape memory metal interconnecting the other end of said getter spring and said shield cup.

20. A cathode-ray tube according to claim 1, wherein said shape memory metal is selected from a group consisting of a Ni-Cr alloy, a Ni-Ti alloy, a Cu-Al alloy, a Cu-Zn alloy and Cu-Zn-Al alloy.

21. A cathode-ray tube according to claim 3, wherein said shield cup has a substantially cylindrical side wall and wherein said particle shielding element is hollow and substantially frusto-conical and has a small-diameter end portion secured to said cylindrical side wall of said shield cup and a large-diameter portion disposed in contact with said electroconductive layer, said particle shielding element being formed of a plurality of turns of coiled rod of a shape memory metal, the turns of coil being disposed in substantially side-by-side contacting relationship wit each other to form a substantially continuous frustoconical wall which substantially closes said gap, said large-diameter portion having been deformed so as not to interfere with said electroconductive layer when said particle shielding element is inserted into said neck glass tube.

22. A cathode-ray tube according to claim 20, wherein said shape memory metal is selected from a group consisting of a Ni-Ti alloy and a Cu-Zn-Al alloy.

23. A method of preparing a particle shielding element to be inserted into a neck glass tube of a cathode-ray tube together with an electron gun so as to close a gap defined between an inner peripheral surface of said neck glass tube and a shield cup of said electron gun so that the latter is guarded against invasion of particle, said method comprising the steps of:

preparing a blank of a shape memory metal;

shaping said blank to form a particle shielding element having an initial, hollow and generally frusto-conical shape having a small-diameter end portion of a diameter to be secured to said shield cup and a large-diameter portion to be disposed in contact with said inner peripheral surface of said neck glass tube;

processing the particle shielding element with a shape memory treatment; and deforming at least said large-diameter portion of said particle shielding element to reduce an outer diameter of said large-diameter portion to a dimension smaller than an inner diameter of said neck glass tube so that said particle shielding element can be inserted into said neck glass tube without interference with said neck glass tube inner peripheral surface.

24. The method of claim 23, wherein said blank is prepared from a sheet of the shape memory metal and shaped into said initial shape by use of forming means.

* * * * *